US010431950B2

(12) United States Patent
Rzasa et al.

(10) Patent No.: US 10,431,950 B2
(45) Date of Patent: Oct. 1, 2019

(54) SMART CONDUCTOR/CONNECTOR SELECTING DIE

(71) Applicant: Hubbell Incorporated, Shelton, CT (US)

(72) Inventors: Michael Paul Rzasa, Nashua, NH (US); Alan Douglas Beck, Bow, NH (US); Evan Martin, Derry, NH (US); Peter Wason, Manchester, NH (US); Daniel Owens, Brookline, NH (US)

(73) Assignee: Hubbell Incorporated, Shelton, CT (US)

( * ) Notice: Subject to any disclaimer, the term of this patent is extended or adjusted under 35 U.S.C. 154(b) by 1281 days.

(21) Appl. No.: 14/183,049

(22) Filed: Feb. 18, 2014

(65) Prior Publication Data

US 2015/0236464 A1 Aug. 20, 2015

(51) Int. Cl.
*H01R 43/058* (2006.01)
*H01R 4/20* (2006.01)

(52) U.S. Cl.
CPC ..... *H01R 43/058* (2013.01); *H01R 4/20* (2013.01); *Y10T 29/53235* (2015.01)

(58) Field of Classification Search
CPC .... H01R 43/058; H01R 4/20; Y10T 29/53235
USPC .... 29/753, 748, 747, 745, 729, 700; 81/426; 72/416
See application file for complete search history.

(56) References Cited

U.S. PATENT DOCUMENTS 2,761,339 A 9/1956 Lazar et al.
2,853,908 A 9/1958 Logan
3,098,517 A 7/1963 Zell et al.
3,226,968 A 1/1966 Holmes
3,345,692 A 10/1967 Cobaugh et al.
3,706,219 A 12/1972 Hoffman et al.
3,732,718 A 5/1973 Barberio et al.
4,825,682 A 5/1989 Orav et al.
5,421,186 A 6/1995 Lefavour
5,568,746 A 10/1996 Colligan et al.
6,604,403 B1 8/2003 Eslambolchi et al.
6,769,173 B2 8/2004 Chadbourne
6,997,028 B2 2/2006 Schmode
7,628,052 B2 12/2009 Zhang
7,762,117 B2 7/2010 Faucher et al.
8,001,822 B2 8/2011 Chadbourne
8,112,877 B2 2/2012 Xie et al.
2004/0244188 A1 12/2004 Hutchinson
(Continued)

OTHER PUBLICATIONS

PCT/US2015/016374 International Search Report and Written Opinion dated May 20, 2015.

*Primary Examiner* — Peter Dungba Vo
*Assistant Examiner* — Azm A Parvez
(74) *Attorney, Agent, or Firm* — Michael Best & Friedrich, LLP

(57) ABSTRACT

A crimping die includes a tool engaging surface, a crimping area, and at least one selecting aperture to assist a user in selecting an appropriate connector or an appropriate conductor for use with the crimping die. The crimping die may include a first selecting aperture indicating an appropriately sized connector to be crimped with the die, a second selecting aperture indicating a minimum sized conductor to be crimped with the die, and a third selecting aperture indicating a maximum sized conductor to be crimped with the die.

20 Claims, 7 Drawing Sheets

(56) References Cited

U.S. PATENT DOCUMENTS

| | | | | |
|---|---|---|---|---|
| 2005/0126255 | A1 | 6/2005 | Bitz | |
| 2008/0307934 | A1* | 12/2008 | Coe | B25B 7/02 72/409.16 |
| 2010/0101379 | A1 | 4/2010 | Hofmann et al. | |
| 2012/0144893 | A1 | 6/2012 | Battenfeld | |
| 2012/0314226 | A1 | 12/2012 | Kelly | |
| 2013/0125610 | A1 | 5/2013 | Bowles et al. | |

* cited by examiner

SMART CONDUCTOR/CONNECTOR SELECTING DIE

FIELD OF THE INVENTION

The present invention relates to crimping dies for attaching connectors to electrical conductors.

BACKGROUND OF THE INVENTION

Crimping dies are used with compression tools to mechanically secure a connector to one or more conductors. Typical compression tools include a diehead assembly that develops substantial crimping force. Standard compression tools may be operated using hydraulic, electric, pneumatic, or manual power.

During a crimping operation, one or more conductor wires are initially striped of any insulation at least at their ends and placed in contact with the connector. The connector and conductor(s) are assembled and are then placed into the diehead assembly. The diehead assembly includes a pair of jaws that retain crimping dies designed to apply a crimping force to the connector. Upon actuation of the compression tool, a moveable crimping die compresses and deforms the connector, securing it to the conductor(s). After crimping is complete, the tool is disengaged by retracting the moveable die.

Crimping is used in a variety of fields to attach different sizes and types of connectors to different sizes and types of conductors. Matching appropriately sized dies, connectors and conductors is important to obtain a secure connection.

SUMMARY OF THE INVENTION

In accordance with an embodiment, a crimping die includes a tool engaging surface, a crimping area, and a first selecting aperture. The first selecting aperture is configured to indicate an appropriately sized connector or an appropriately sized conductor relative to the crimping surface.

In accordance with another embodiment, a crimping die includes an outer body and an inner body. The outer body has a tool engaging surface, a first end, and a second end. The inner body has includes a crimping area. The crimping die also includes a first selecting groove, a second selecting groove, and a third selecting groove.

In accordance with another embodiment, a crimping die includes a tool engaging surface, a crimping area, a minimum conductor groove, a maximum conductor groove, and a connector selecting groove. The minimum conductor groove indicates a minimum sized conductor to be crimped with the die. The maximum conductor groove indicates a maximum sized conductor to be crimped with the die. The connector selecting groove indicates an appropriately sized connector to be crimped with the die.

Other embodiments, including apparatus, systems, methods, and the like which constitute part of the invention, will become more apparent upon reading the following detailed description of the exemplary embodiments and viewing the drawings. The foregoing general description and the following detailed description are exemplary and explanatory only, and therefore, not restrictive.

BRIEF DESCRIPTION OF THE DRAWINGS

The accompanying drawings are incorporated in and constitute a part of the specification. In such drawings.

DETAILED DESCRIPTION OF THE INVENTION

Figure 1:
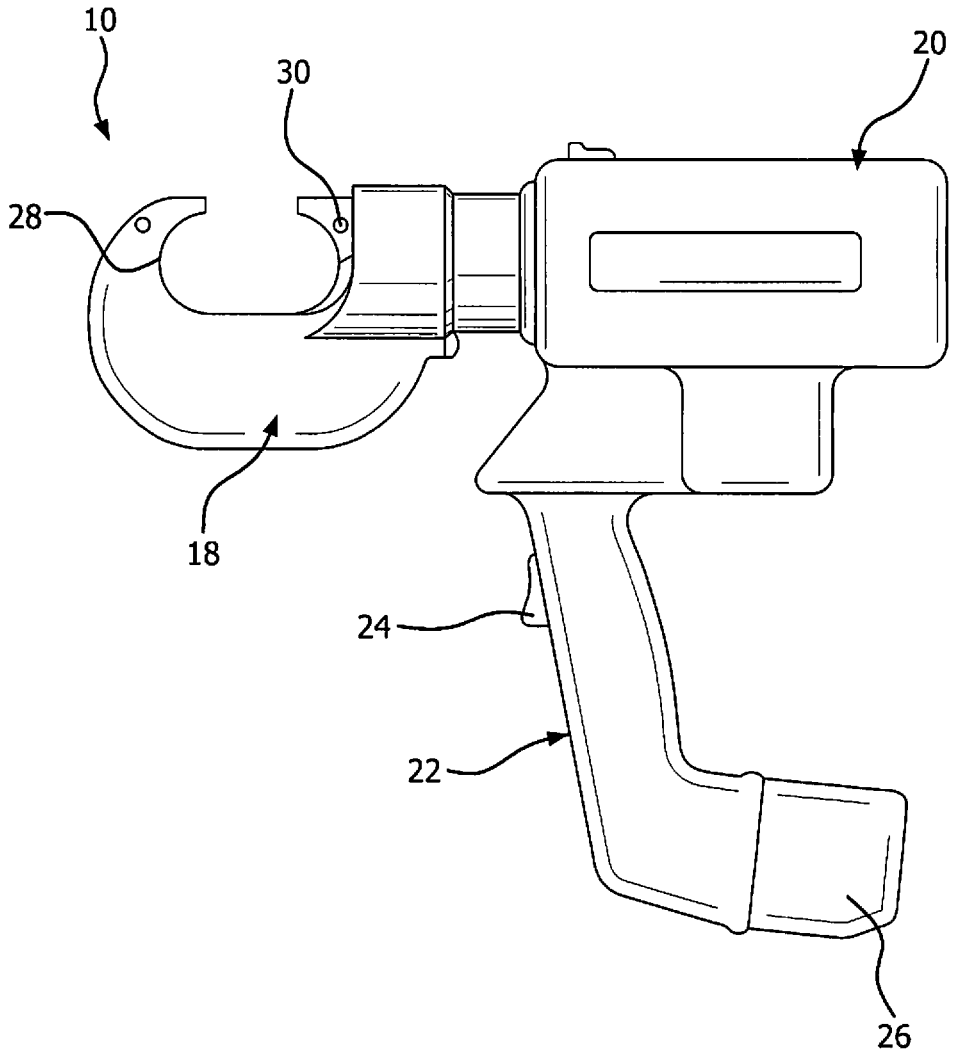
FIG. 1 (Prior Art)
FIG. 1 is a side elevational view of an exemplary crimping tool.

Reference will now be made in detail to the exemplary embodiments of the invention as illustrated in the accompanying drawings, in which like reference characters designate like or corresponding parts throughout the drawings.

FIG. 1 shows a battery powered, hydraulic crimping tool 10. The crimping tool 10 described is an exemplary and conventional tool for use with a set of crimping dies 12 to crimp a connector 14 to a conductor 16. The crimping dies 12 described herein, however, may be used with any suitable type of crimping tool including, for example, a manual, pneumatic, hydraulic, or electrically powered tool. Various examples of crimping tools that may be used with the crimping dies 12 described herein include the Burndy® MD6 series; MD7 series; OUR840 series; Y500CTHS series; PAT600 series; PATMD6 series; 35 series; 39 series; 750 series; Y45 series; and 46 series crimping tools, although other crimping tools may be utilized as would be understood by one of skill in the art.

The crimping tool 10 has a tool head 18, a motor housing 20, and a handle 22 having a trigger 24 and a battery 26. The tool head 18 includes a stationary jaw 28 and a moveable jaw 30. The moveable jaw 30 is adapted to laterally translate towards and away from the stationary jaw 28. The stationary jaw 28, the moveable jaw 30, or both are configured to removably receive crimping dies 12. Although not shown, the basic components of the motor housing 20 include a motor, a fluid pump, and a fluid reservoir. The motor is powered by the battery 26 and actuates the fluid pump. The fluid pump displaces fluid from the fluid reservoir to move a ram (not shown). The ram is connected to the moveable jaw 30 to translate the moveable jaw 30 into a crimping position. After a crimping operation, a spring (now shown) biases the ram into the initial position, moving the moveable jaw 30 away from the stationary jaw 28. The crimping tool 10 includes more detailed components not described here, but would be understood by one of ordinary skill in the art.

Figure 2:
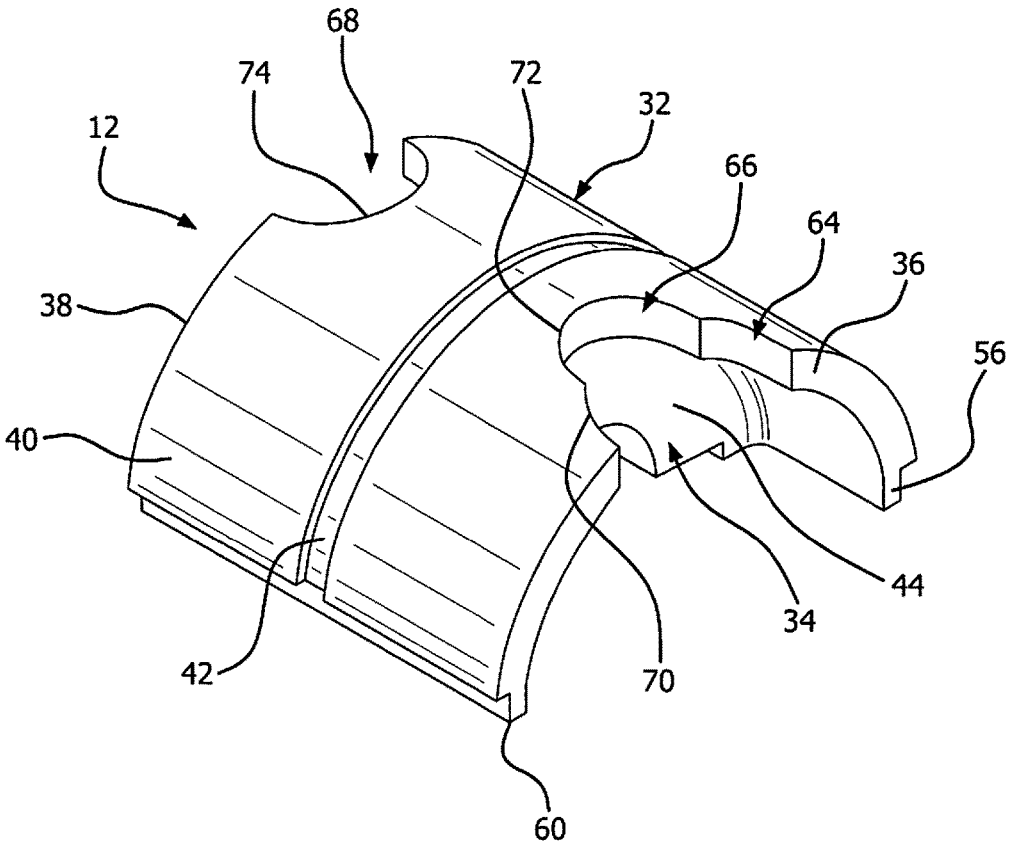
FIG. 2 is a perspective view of a crimping die according to an exemplary embodiment of the invention.
Figure 3:
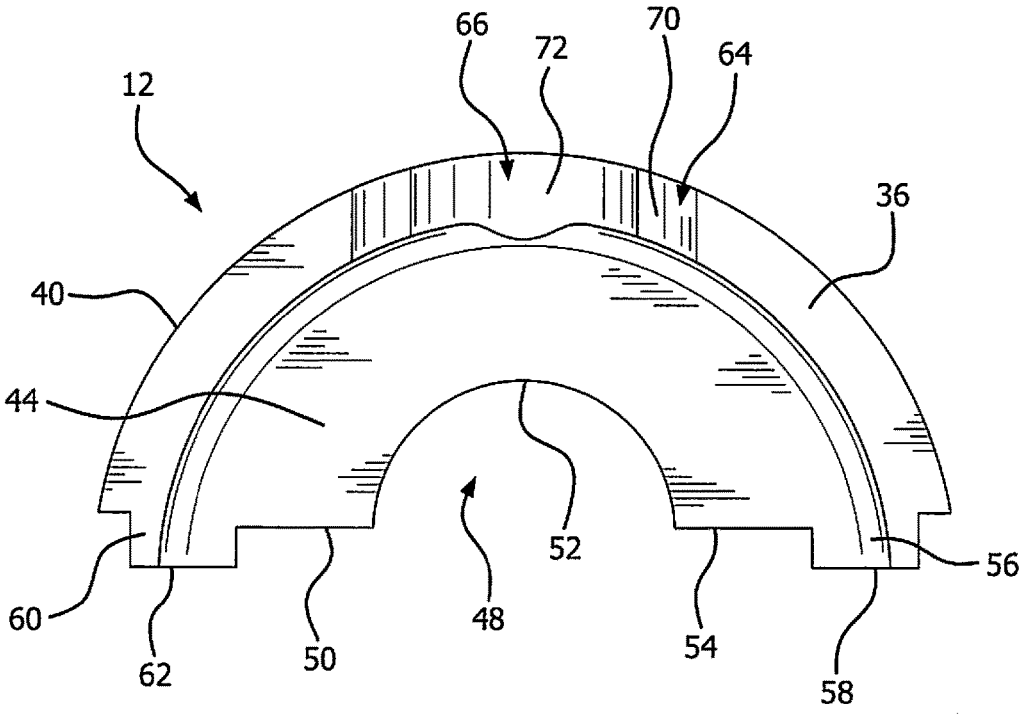
FIG. 3 is a front elevational view of the exemplary crimping die of FIG. 2.
Figure 4:
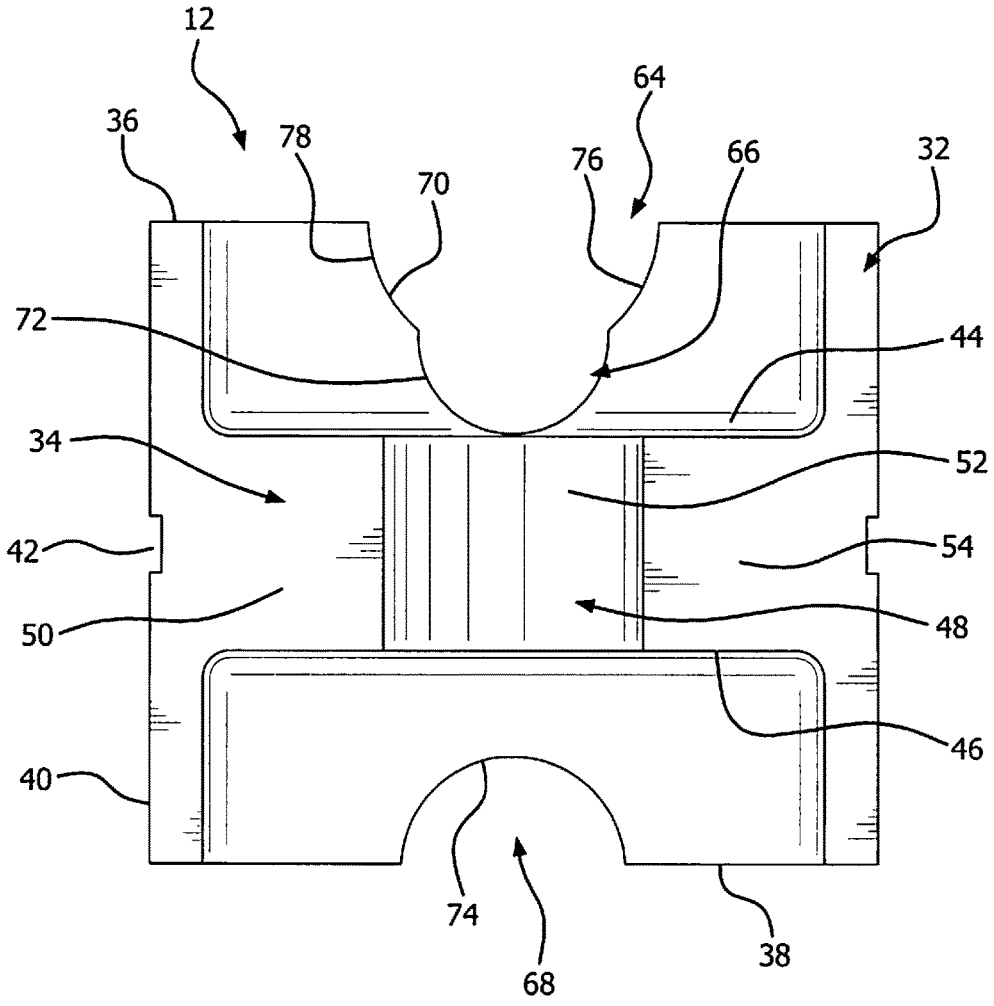
FIG. 4 is a bottom elevational view of the exemplary crimping die of FIG. 2.
Figure 5:
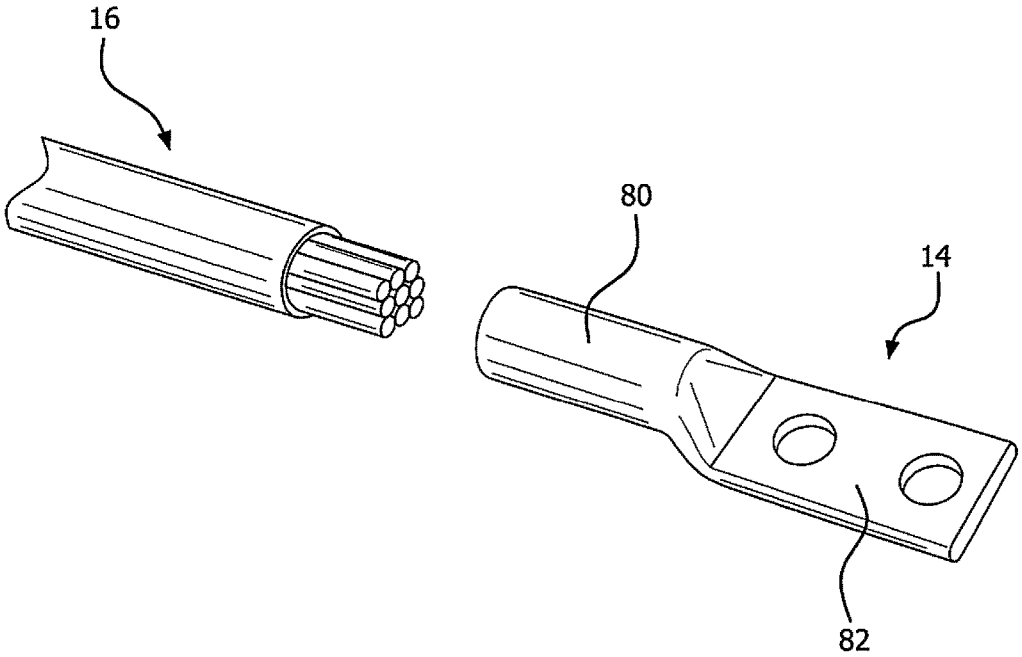
FIG. 5 is a perspective view of a connector and conductor to be used with the die of FIG. 2.

FIGS. 2-4 depict an exemplary crimping die 12 according to the invention. The crimping die 12 is U-shaped. In various alternative embodiments, the features discussed herein may be used with any type of crimping die 12 including C, J, L, P, S, U, W, X, Nest, and Indentor type dies. The crimping die 12 is made from a rigid material capable of withstanding high compressive forces, for example the compressive forces generated by a 6, 12, or 15 Ton hydraulic pressure tool. In an exemplary embodiment, the crimping die 12 can withstand compressive forces of 14,000 psi and higher over repeated uses. The crimping die 12 may be made from a metal alloy or steel, for example stainless steel. The crimping die 12 may also be made from high strength plastic composites, a ceramic material, or any combination of materials.

The crimping die 12 has an outer body 32 and an inner body 34. The outer body 32 extends coaxially beyond the inner body 34 on two axial sides from a first end 36 to a second end 38 of the outer body and includes a tool engaging surface 40. The outer body 32 and inner body 34 are unitary and integral with one another. The outer body 32 has a substantially semi-cylindrical shape with the tool engaging surface 40 being semicircular in transverse cross section. The tool engaging surface 40 interfaces with a jaw of a crimping tool 10, for example the stationary jaw 28 or moveable jaw 30 shown in FIG. 1. A channel 42 is provided in the tool engaging surface 40 of the outer body 32 and may assist in removably securing the crimping die 12 to the crimping tool 10. For example, the channel 42 may slidably engage a mating projection present in a crimping jaw to properly align the crimping die 12. The shape, size, and features of the tool engaging surface may be alternatively configured to interface with any known type of crimping tool.

The inner body 34 has a substantially semi-cylindrical shape and extends axially latterly from a first end 44 to a second end 46. The inner body 32 includes a crimping area 48 for crimping an electrical connector. As best shown in FIGS. 3 and 4, the crimping area 48 includes a first planar crimping surface 50, an arcuate crimping surface 52, and a second planar crimping surface 54. The arcuate crimping portion 52 has a radius of curvature less than that of the connector to be crimped and compresses the connector 14 causing a reduction in the diameter of the connector 14. The excess material created by the reduction in diameter of the connector 14 flows into the regions bound by the first and second planar crimping portions 50, 54, which regions are then flattened. The shape, size, and features of the crimping surface 48 may be alternatively configured to work with any type of connector 14 as would be understood by one of ordinary skill in the art.

The crimping die 12 also includes a first protrusion 56 having a first butting surface 58 and a second protrusion 60 having a second butting surface 62. As best shown in FIG. 3, the first and second protrusions 56, 60 extend from the outer body 32 and the inner body 34. In alternative embodiments, the first and second protrusions 56, 60 may extend from only the outer body 32 or the inner body 24. In operation, the first and second butting surfaces 58, 62 will contact similar butting surfaces on an opposing die (not shown). The butting surfaces 58, 62 act as stops to prevent over compression of the connector 14.

When using the crimping die 12, utilizing a correctly sized connector 14 as well as a correctly sized conductor 16 is important. The crimping die 12 may be associated with a single connector size and other crimping dies may be provided of smaller and larger sizes to work with smaller or larger connectors 14 respectively. For example, a set of crimping dies 12 may be provided sized in the range of #6 American Wire Gauge (AWG) to 750 circular mils (kcmil). Although associated with a single connector 14, the crimping die 12 may be capable of crimping its associated connector 14 with conductors 16 of various sizes. Failing to choose a proper crimping die 12, connector 14, and conductor 16 may result in an inadequate or unsecure connection, possibly leading to dangerous conditions. If an incorrect component is chosen, the person performing the crimping operation may need to make multiple attempts to achieve a proper connection, resulting in wasted time and resources.

To assist in selecting the correct connector 14 and conductor 16, the exemplary crimping die 12 includes at least one selecting aperture 64. As shown in FIGS. 2-4, the crimping die 12 may also include a second selecting aperture 66 and a third selecting aperture 68. In the exemplary embodiment, the first selecting aperture 64 includes a connector selecting groove 70, the second selecting aperture 66 includes a minimum conductor groove 72, and the third selecting aperture 68 includes a maximum conductor groove 74. As best shown in FIGS. 2 and 4, the connector selecting groove 70 and the minimum conductor groove 72 share an opening and are positioned adjacent to one another in the first end 36 of the outer body 32 and the maximum conductor groove 74 is positioned in the second end 38 of the outer body 32.

The minimum conductor groove 72 includes a semi-circular surface configured to indicate a conductor 16 of a minimum size associated with the crimping die 12 or associated with the connector 14. The connector selecting groove 70 includes a first arcuate side 76 extending from the minimum conductor groove 72 and a second arcuate side 78 extending from the minimum conductor groove 72 opposite the first arcuate side 76. The first and second arcuate sides 76, 78 are configured to indicate an appropriately sized connector 14 associated with the crimping die 12. The maximum conductor groove 74 includes a semi-circular surface configured to indicate a conductor 16 of a maximum sized associated with the crimping die 12 or associated with the connector 14. Indicating as used herein may mean any method of visually or tactily indicating an appropriate size to a user. For example, the grooves 70, 72, 74 may capable of receiving the sized connector or conductor snugly so that all points of the grooves 70, 72, 74 are touching the associated connector 14 or conductor 16 at one or more points, or receiving the connector 14 or conductor 16 with a slight tolerance so that it fits within the associated groove 70, 72, 74 closely but without necessary engagement.

Although depicted as arcuate slots or open-ended grooves formed in the crimping die 12, selecting apertures 64, 66, 68 may be any size, shape, or type of opening. For example, one or more of the selecting apertures 64, 66, 68 may be a closed opening, such as a through hole or a blind hole formed in the crimping die 12. One or more of the selecting apertures 64, 66, 68 may also have linear sides or a polygonal configuration. Different configurations, orientations and sizes may be utilized depending on the type of crimping die 12, the type of connector 14, the type of conductor 16, and the type of crimping tool 10 as would be understood by one of ordinary skill in the art.

FIGS. 2-4 show the first and second selecting apertures 64, 66 positioned adjacent to one another extending from first end 36 of the outer body 32 and the third selecting aperture extending from the second end 38 of the outer body 32. The selecting apertures 64, 66, 68 are also positioned approximately along a single axis that runs along the center of the crimping die 12. In various exemplary embodiments, the location of the apertures 64, 66, 68 may vary. For example, the selecting apertures 64, 66, 68 may be positioned in the sides of the tool engaging surface 40 as opposed to the first and second ends 36, 38. The position of the selecting apertures 64, 66, 68 may be adjusted dependent on the size, shape, and type of die as well as the crimping operation.

The crimping die 12 need not have all three selecting apertures 64, 66, 68 and various alternative embodiments may include a single selecting aperture or more than three selecting apertures. For example, the crimping die 12 may have only a first selecting aperture 64 that indicates an appropriately sized connector 14. The crimping die 12 may also have only a first selecting aperture 64 and a second selecting aperture 66 indicating a minimum conductor 16 and a maximum conductor 16 or an appropriately sized connector 14 and one of a minimum conductor 16 and maximum conductor 16. In various exemplary embodiments, the crimping die 12 may also have an optimal size connector groove (not shown). The number and type of selecting apertures may be adjusted dependent on the size, shape, and type of die as well as the crimping operation.

As best shown in FIGS. 5-8, the crimping die 12 is used to crimp a connector 14 to a conductor 16. The connector 14 has a connector barrel 80 and a connector head 82. The crimping die 12 may be used with a variety of connectors 14 and various sized conductors 16. For example, the crimping die 12 may be used with Burndy® HYLUG™ and HYLINK™ type connectors 14, although any type of connectors 14 may be used as would be understood by one of ordinary skill in the art.

During a crimping operation, a user may have a variety of crimping dies 12, connectors 14, and conductors 16 at their disposal. The user may not know the exact sizes of one or more of these components for a number of reasons, including the component is not labeled, the component's label has become faded, scratched, or otherwise unreadable, and/or the component has been misplaced, for example in a different compartment of a case or toolbox. In these and other instances, it is difficult and time consuming for a user to select an appropriate combination of a crimping die 12, connector 14, and conductor 16. Utilizing a crimping die 12 having one or more selecting apertures 64, 66, 68 enables a user to quickly select the appropriate crimping die 12, connector 14, and conductor 16 with confidence that a secure connection will be achieved.

For example, a user may have the crimping die 12 or a set of different sized crimping dies 12 as discussed above, and an appropriate connector 14. The user places the connector 14 into the connector selecting groove 70 to find the appropriate crimping die 12. Once the user has found the correct crimping die 12, they may select a conductor 16 and place it in the minimum conductor groove 72 and the maximum conductor groove 74. If the selected conductor 16 is equal to or larger than the minimum conductor groove 72 as well as equal to or smaller than the maximum conductor groove 74, the user will know that they have selected an appropriately sized conductor 16. If the selected conductor 16 does not meet one of the size requirements, the user may select a different conductor 16. In certain instances, the user may know that the selected conductor 16 is an appropriate size after comparing the conductor to one of the minimum conductor groove 72 or maximum conductor groove 74.

In certain instances, the user may have the crimping die 12 or a set of different sized crimping dies 12, and an appropriate conductor 16. The user places the conductor 16 in the minimum conductor groove 72 and/or the maximum conductor groove 74 of one or more crimping dies 12 until an appropriate crimping die 12 is found. The user may then place various connectors 14 into the connector selecting groove 70 of the appropriate crimping die 12 until an appropriately sized connector 14 is found.

In other instances, the user may know the correct size crimping die 12 they wish to use, but do not know the correct connector 14 or conductor 16 to use. For example, the crimping dies 12 may be labeled with the size or gauge of the connector 14 and the user may select the appropriate crimping die 12 based on the label. The user may then place various connectors 14 into the connector selecting groove 70 of the appropriate crimping die 12 until an appropriately sized connector 14 is found. The user also places various conductors 16 into the minimum conductor groove 72 and/or the maximum conductor groove 74 to find an appropriately sized conductor 16. In any of the scenarios discussed above, the user need not know the size of the connector 14, the sizes of the conductors 16, or the sizes of the crimping dies in order to mate the appropriate crimping die 12, connector 14, and conductor 16.

Figure 6:
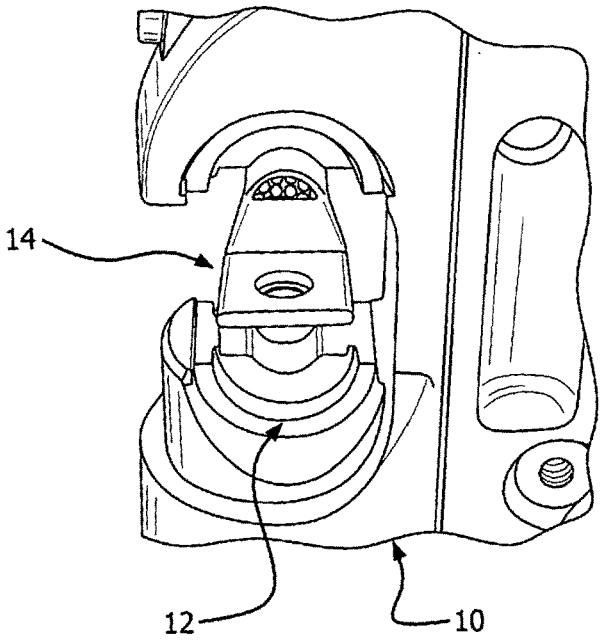
FIG. 6 is a perspective view of the initial stage of a crimping cycle, prior to compression, using the die of FIG. 2.
Figure 7:
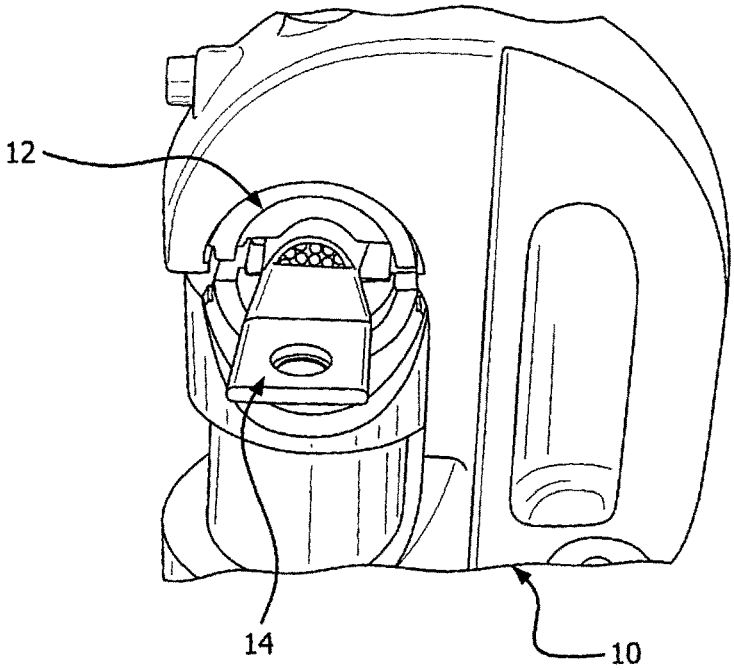
FIG. 7 is a perspective view of the compression stage of a crimping cycle using the die of FIG. 2.
Figure 8:
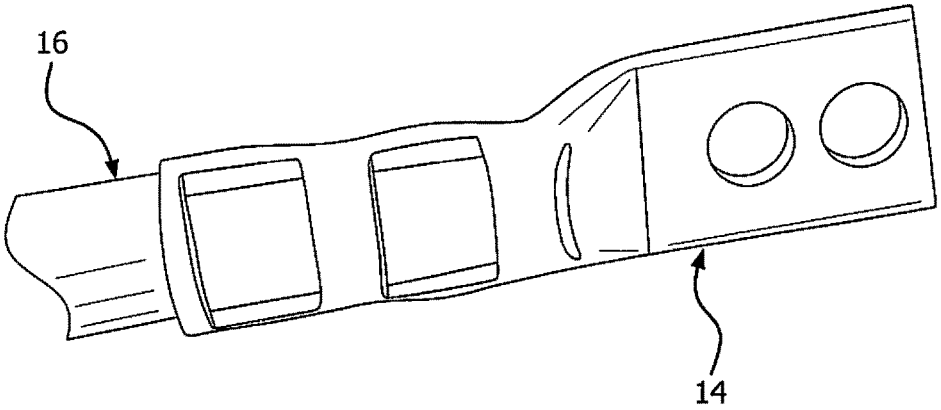
FIG. 8 is a perspective view of the attached connector and conductor shown in FIG. 5 after crimping.

After the user has selected the appropriate crimping die 12, the appropriate connector 14, and the appropriate conductor 16, the user then measures an appropriate strip length and strips the appropriate amount of insulation from the conductor 16 using a wire stripper or other similar tool (not shown). The user then inserts the conductor 16 into the connector barrel 80. The user also places the appropriate crimping die 12 into the crimping tool 10, as depicted in FIGS. 6 and 7, by placing a first die in the stationary jaw 28 and a second opposing die in the moveable jaw 30. After the crimping dies 12 are set up and the conductor 16 is inserted into the connector 14, the connector 14 is placed in the crimping tool 10 between the stationary jaw 28 and the moveable jaw 30 as shown in FIG. 7. The user may then initiate a crimping cycle, compressing the conductor barrel 80 with the moveable jaw 30 as shown in FIG. 8. After the crimping operation, the connector 14 is secured to the conductor 16 as shown in FIG. 9.

The foregoing detailed description of the certain exemplary embodiments has been provided for the purpose of explaining the principles of the invention and its practical application, thereby enabling others skilled in the art to understand the invention for various embodiments and with various modifications as are suited to the particular use contemplated. This description is not necessarily intended to be exhaustive or to limit the invention to the precise embodiments disclosed. Any of the embodiments and/or elements disclosed herein may be combined with one another to form various additional embodiments not specifically disclosed. Accordingly, additional embodiments are possible and are intended to be encompassed within this specification and the scope of the appended claims. The specification describes specific examples to accomplish a more general goal that may be accomplished in another way.

What is claimed:

1. A crimping die comprising:

an outer body having a tool engaging surface;

an inner body coupled to said outer body having a crimping area;

a first selecting aperture in said outer body configured to indicate one of an appropriately sized connector and an appropriately sized conductor relative to the crimping area.

2. The crimping die of claim 1 wherein said tool engaging surface comprises an arcuate surface.

3. The crimping die of claim 1 wherein said inner body is integral with said outer body.

4. The crimping die of claim 3 wherein said crimping area further comprises a planar surface.

5. The crimping die of claim 1 further comprising a first protrusion having a first butting surface and a second protrusion having a second butting surface.

6. The crimping die of claim 1 wherein
a second selecting aperture is configured to indicate one of an appropriately sized connector and an appropriately sized conductor relative to the crimping area.

7. The crimping die of claim 6 wherein
said first selecting aperture comprises a connector selecting groove and said second selecting aperture comprises a minimum conductor groove.

8. The crimping die of claim 7 further comprising
a third selecting aperture configured to indicate a conductor having a maximum size relative to said connector selecting groove.

9. The crimping die of claim 8 wherein
said connector selecting groove and said minimum conductor groove share an opening.

10. The crimping die of claim 9 wherein
said minimum conductor groove comprises a semi-circular surface.

11. The crimping die of claim 10 wherein
said connector selecting groove comprises a first arcuate side and a second arcuate side extending from said minimum conductor groove.

12. The crimping die of claim 11 wherein
said maximum conductor groove comprises a semi-circular surface.

13. A crimping die comprising:
an outer body having a tool engaging surface, a first end, and a second end;
an inner body coupled to said outer body having a crimping area;
a first selecting groove in said outer body;
a second selecting groove in said outer body; and
a third selecting groove in said outer body.

14. The crimping die of claim 13 wherein
said first selecting groove comprises a connector selecting groove configured to receive an appropriately sized connector.

15. The crimping die of claim 13 wherein
said second selecting groove comprises a minimum conductor groove configured to receive a minimum sized conductor.

16. The crimping die of claim 13 wherein
said third selecting groove comprises a maximum conductor groove configured to receive a maximum sized conductor.

17. The crimping die of claim 13 wherein
said first selecting groove and said second selecting groove are positioned in said first end.

18. The crimping die of claim 13 wherein
said outer body and said inner body define a U-type crimping die.

19. A crimping die comprising:
an outer body having a tool engaging surface;
an inner body coupled to said outer body having a crimping area;
a minimum conductor groove in said outer body indicating a minimum sized conductor to be crimped with the die;
a maximum conductor groove in said outer body indicating a maximum sized conductor to be crimped with the die;
a connector selecting groove in said outer body indicating an appropriately sized connector to be crimped with the die.

20. The crimping die of claim 19 wherein
said outer body includes a first end and a second end, said minimum conductor groove and said connector selecting groove positioned in said first end and said maximum conductor groove is positioned in said second end.

* * * * *